US005524609A

United States Patent [19]

Krull

[11] Patent Number: 5,524,609

[45] Date of Patent: Jun. 11, 1996

[54] SCENT GENERATOR FOR GAS FIREPLACES

[76] Inventor: Donald L. Krull, 603 5th Ave., Alton, Iowa 51003

[21] Appl. No.: 422,883

[22] Filed: Apr. 17, 1995

[51] Int. Cl.[6] ..... F24B 1/18

[52] U.S. Cl. ..... 126/500; 126/59.5; 44/535; 431/126; 431/125

[58] Field of Search ..... 126/500, 59.5, 126/25 R, 41 R; 44/535; 431/356, 125, 126, 288

[56] References Cited

U.S. PATENT DOCUMENTS

| | | | |
|---|---|---|---|
| 3,660,055 | 5/1972 | Haller | 44/535 |
| 3,948,445 | 4/1976 | Andeweg | 239/53 |
| 4,735,358 | 4/1988 | Morita et al. | 239/52 X |
| 4,895,511 | 1/1990 | Schmid | 431/126 |
| 5,048,406 | 9/1991 | Cofer | 99/482 |
| 5,127,922 | 7/1992 | Bension | 44/275 |
| 5,301,606 | 4/1994 | Ferguson | 99/482 |
| 5,425,789 | 6/1995 | Lewtas et al. | 44/391 |

*Primary Examiner* Larry Jones
*Attorney, Agent, or Firm* Larson & Taylor

[57] ABSTRACT

Apparatus for releasing a scent upon exposure to heat including a housing formed by a cover member and a base member, a carrier material disposed within the housing and a scented material dispersed in the carrier material. The carrier material has a melting point of at least 185° F. and is both chemically and physically stable at temperatures of up to 550° F. This apparatus is particularly suitable for providing a pleasant scent to a room in association with a gas fireplace.

9 Claims, 1 Drawing Sheet

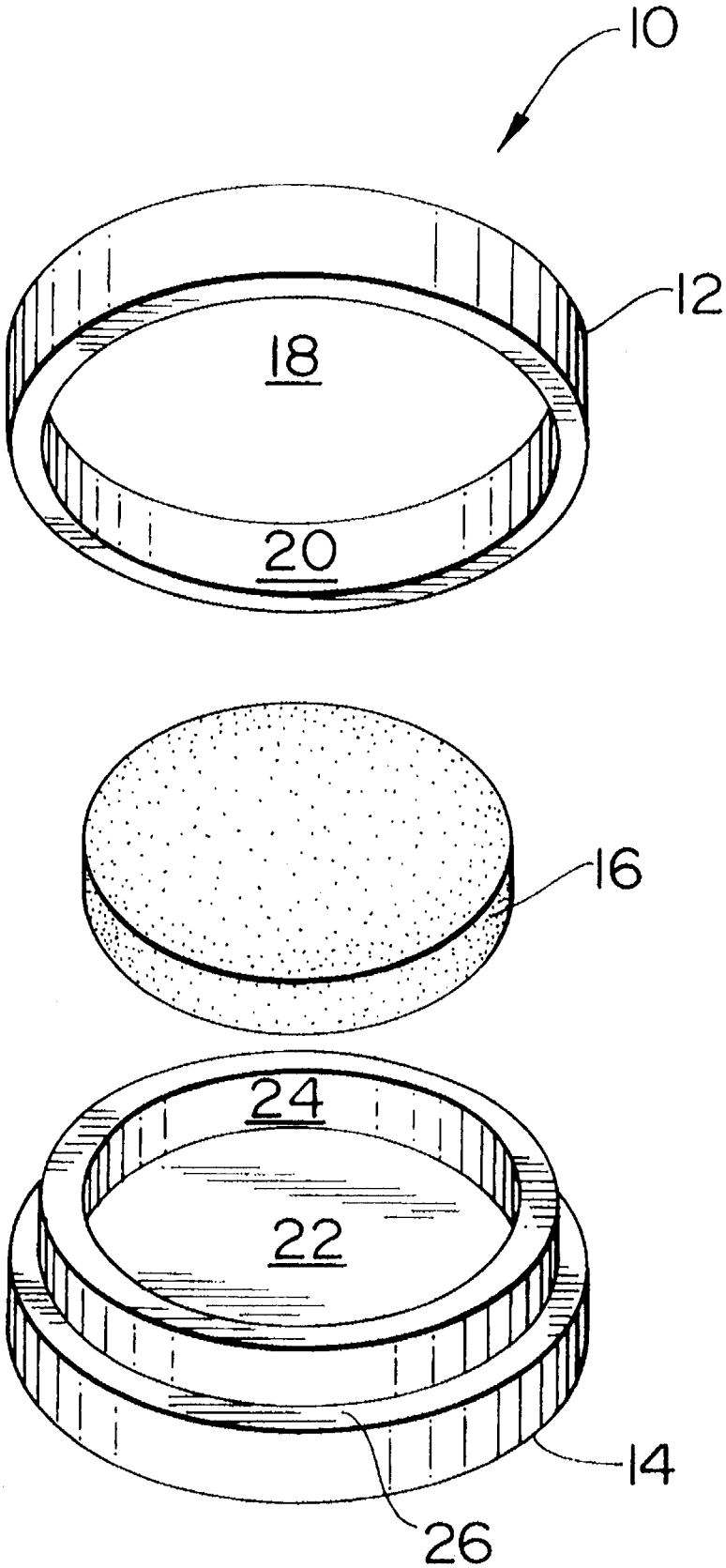
10
12
18
20
16
24
22
14
26

SCENT GENERATOR FOR GAS FIREPLACES

FIELD OF THE INVENTION

The present invention relates in general to a scent generator for the release of a fragrance when exposed to high temperatures in, for example, a gas fireplace.

BACKGROUND OF THE INVENTION

Fireplaces are very popular in many households. However, recent studies have shown that wood-burning fireplaces may produce pollution. This has led, in some areas, to restrictions on the use of wood-burning fireplaces.

As a result, many existing fireplaces are being modified to burn gas and new fireplace installations are often gas-burning fireplaces rather than wood-burning fireplaces. Gas-burning fireplaces have the advantage that they generate significantly less pollution than wood-burning fireplaces and that they do not require messy, bulky firewood for fuel.

However, gas fireplaces suffer from the disadvantage that they generally do not provide the pleasant aroma which is associated with wood-burning fireplaces. This pleasant aroma is an important characteristic of wood-burning fireplaces which is partially responsible for their popularity. Thus, it is desirable to provide a means for generating an aroma in association with a gas fireplace to thereby achieve a semblance of the ambiance of a wood-burning fireplace.

U.S. Pat. No. 3,660,055 (Haller) discloses a scented fireplace fuel. The fuel is in the form of logs of predetermined length to which a durable coating is applied. An essential oil is encapsulated in the durable coating and includes a pleasant scent. The coating is designed to minimize dissipation of the scent while the logs are stored or burned in order to prolong the release of the scent during burning.

However, the concept of Haller is not useful for gas fireplaces since in gas fireplaces nothing is actually burned other than gas. Thus, it would be inappropriate to place logs into such a fireplace in order to provide a scent to the fire.

Other methods for dispersing scents are disclosed in U.S. Pat. Nos. 3,948,445 (Andeweg) and 5,301,606 (Ferguson). The Andeweg patent provides a vapor generator with air-freshening material and/or insecticide materials stored in a porous material and which is subject to heat accelerated vaporization release. Controlled vapor release of the stored material is attained through moderate heating and exposure of the storage material in the generator. However, the Andeweg reference employs materials and generators which are not suitable for the high temperatures which will be encountered in a gas fireplace.

The Ferguson reference relates to a gas-emitting apparatus which consists of a housing made of a thermally-conductive material and which includes a pyrolytic or combustible cartridge removably inserted into the housing. Again, the device of Ferguson is not appropriate for gas fireplaces since it employs a cartridge which is burned in use. The burning is necessary in Ferguson since its primary objective is to generate smoke rather than a pleasant scent.

Accordingly, there remains a need in the art for a scent-generating device which is suitable for use in gas fireplaces.

SUMMARY OF THE INVENTION

The principal object of the present invention is to provide a scented material which can be employed in a gas fireplace to provide a scent to the room during use of the fireplace.

This object is accomplished by provision of an apparatus which includes a housing formed by a cover member and a base member, which cover member is releasably attachable to said base member to close the housing. Inside the housing is provided a carrier material which has a melting point of at least 175° F. and which, after melting, is chemically and physically stable up to 550° F. A scented material is dispersed in the carrier material in such a manner that the scented material is released upon melting of the carrier material by exposure to heat.

It is a further object of the present invention to provide an apparatus for releasing a scent upon exposure to heat which does not require pyrolysis or combustion of any components of the apparatus. In this manner no ash or other waste products are generated by pyrolysis or combustion.

A further object of the present invention is to provide an apparatus for releasing a scent upon exposure to heat which includes a carrier material for the scent which carrier material is recyclable.

Details of the invention and the foregoing objects are set forth in the following specification and drawing which accompanies it.

BRIEF DESCRIPTION OF THE DRAWING

The single FIGURE is a perspective exploded view of an apparatus according to the present invention.

DETAILED DESCRIPTION OF THE PREFERRED EMBODIMENTS

The preferred embodiment of the present invention is shown in the single FIGURE.

The scent generating apparatus 10 shown in the FIGURE includes a cover 12, a base member 14 and a heat activated cartridge 16. The cover 12 and base member 14 together form a housing for the heat activated cartridge 16. The housing must be capable of withstanding temperatures of up to 550° F. and is preferably fabricated from a heat conductive material. Suitable materials are ceramics, metals such as tin, aluminum and steel, and glass.

Cover 12 includes a top 18 and a upper sidewall 20 which extends circumferentially around cover 12. Base member 14 is comprised of a bottom 22 and a lower sidewall 24 which extends circumferentially around base member 14.

Lower sidewall 24 of base member 14 includes a circumferential lip 26 thereon. Circumferential lip 26 acts to limit the downward movement of cover 12 when it is fitted over the upper portion of lower sidewall 24 of base member 14. Thus, upper sidewall 20 will fit over the portion of lower sidewall 24 which is above circumferential lip 26. This fit is preferably snug enough so that cover 12 cannot fall off of base member 14 when the scent generating apparatus is inverted.

Heat-activated cartridge 16 fits within base member 14 of scent generating apparatus 10. Cover 12 is then placed over the upper portion of lower sidewall 24 of base member 14 to close the scent generating apparatus 10.

Heat-activated cartridge 16 is comprised of a carrier material and a scented material which is dispersed in the carrier material. Preferably, the scented material is homogeneously dispersed in the carrier material by for example mixing the scented material into the carrier material in the melt form.

Suitable carrier materials for use in the apparatus of the present invention have a melting point of at least 175° F. and more preferably have a melting point between 185° F. and 275° F. In addition, the carrier material should be chemically and physically stable up to temperatures of about 550° F. By chemically and physically stable it is meant that the carrier material does not undergo pyrolysis, combustion, or other significant chemical change and that it does not boil or otherwise undergo a physical change. It is the intention that the carrier material will be melted when exposed to typical temperatures for gas fireplaces and that it will resolidify upon removal from the fireplace or extinguishing of the gas flame.

A unique characteristic of the present invention is that the carrier material is essentially inert and will remain in the apparatus even when all of the scented material has been exhausted. In this manner, no pollutants are released into the air by use of the device of the present invention and no waste material in the form of ash or other residues of pyrolysis or combustion are created. Thus, once the scented material is exhausted, the carrier material can be recycled or otherwise disposed of by the user. This makes for an environmentally friendly apparatus.

Suitable carrier materials include saturated hydrocarbon polymers. Such saturated hydrocarbon polymers will generally have molecular weights of 500–5,000 grams per mole and more preferably 1,000–3,000 grams per mole. Of course, higher molecular weight polymers will be better suited for higher temperature applications since they will typically have higher melting points and will be able to withstand higher temperatures. On the other hand, lower molecular weight materials may be preferable if a rapid melting of the carrier material is desired, for example to quickly provide a scent to a room.

Suitable saturated hydrocarbon polymers include polyethylene homopolymers having molecular weights of 500–3,000 grams per mole. These types of polymers are commercially available and typically melt at temperatures between 175° F. and 275° F., depending upon the molecular weight. Such polyethylene homopolymers are chemically and physically stable at temperatures of up to 550° F. and thus can withstand the extreme temperatures which can be encountered in gas fireplaces. Polywax® (ex. Petrolite) polyethylene homopolymers are suitable for use as the carrier material.

In addition, for cost or other reasons it may be desirable to include minor amounts of other materials in the carrier material. Such additional materials should not materially affect the basic characteristics of the carrier material. For example, it may be desirable to incorporate a limited amount of paraffin in the carrier material in order to reduce its cost without changing its basic characteristics.

The scented material to be employed in the apparatus of the present invention may be any conventional scented material which can be dispersed in the carrier material. Typically, scented materials with relatively high boiling points will be preferred since these will provide a more long lasting effect than scented materials which will boil off at temperatures below 200° F., for example. In any event, it is important that the scented material be volatilized upon melting of the carrier material so that the scented material can accomplish its desired function.

The scented material preferably comprises from 1–10% by weight of the total weight of the heat activated cartridge 16. More preferably, the scented material makes up 3–5% by weight of the total weight of the heat activated cartridge 16. Examples of scented materials are apple, cherry, lilac and pine scent. Essentially, any commercially available scented material can be employed as long as it can be incorporated in the heat activated cartridge 16.

In operation, cover 12 is removed from base member 14 to expose heat activated cartridge 16 to the air. Then, scent generating apparatus 10 is placed in close proximity to a gas fire for example, above the fire on the metal screen typically associated with gas fireplaces. The heat from the fire will heat up scent generating apparatus 10 thereby causing the carrier material to melt. Upon melting of the carrier material the scented material will be gradually volatilized and provide a pleasing scent to the room in which the gas fireplace is located.

EXAMPLE

A tin housing was provided with a heat-activated cartridge of Polywax® (ex. Petrolite), a polyethylene homopolymer with a melting point of 190° F. as the carrier material and, homogeneously mixed in the carrier material, an apple scent. The apparatus, without the cover, was placed on the metal screen above the fire in a gas fireplace and, upon heating, provided a pleasant apple scent to the room.

The present invention has been described with reference to its preferred embodiments. The foregoing description should not be construed as limiting the scope of the invention in any way. The scope of the invention is to be determined by the claims appended hereto.

What is claimed is:

1. An apparatus for releasing a scent upon exposure to heat, which comprises:

a) a housing formed by a cover member and a base member, said cover member being releasably attachable to said base member to open and close said housing;

b) a carrier material disposed within said housing which carrier material has a melting point of at least 185° F. and, after melting, is chemically and physically stable at temperatures up to 550° F.; and c) a scented material dispersed in said carrier material, at least some of said scented material being volatilized upon melting of said carrier material by exposure to heat.

2. An apparatus as claimed in claim 1 wherein the housing is formed from a heat conductive material.

3. An apparatus as claimed in claim 2 wherein the carrier material has a melting point of 185°–275° C.

4. An apparatus as claimed in claim 3 wherein the carrier material comprises at least one saturated hydrocarbon polymer having a molecular weight of 500–5000 g/mole.

5. An apparatus as claimed in claim 4 wherein the saturated hydrocarbon polymer is a polyethylene homopolymer.

6. An apparatus as claimed in claim 5 wherein the carrier material further comprises paraffin.

7. An apparatus as claimed in claim 2 wherein said housing is reclosable between uses of the apparatus.

8. An apparatus as claimed in claim 1 wherein the scented material comprises from 1–10% by weight of the total weight of the carrier material and scented material.

9. An apparatus as claimed in claim 1 wherein the scented material comprises from 3–5% by weight of the total weight of the carrier material and scented material.

* * * * *